US005778288A

United States Patent [19]

Tabb et al.

[11] Patent Number: 5,778,288

[45] Date of Patent: Jul. 7, 1998

[54] ERASE BEFORE A.C. RECHARGE IN COLOR ELECTROGRAPHIC PRINTING

[75] Inventors: Charles H. Tabb; Jeffrey J. Folkins, both of Rochester; Kenneth W. Pietrowski, Penfield, all of N.Y.

[73] Assignee: Xerox Corporation, Stamford, Conn.

[21] Appl. No.: 891,960

[22] Filed: Jul. 14, 1997

[51] Int. Cl.[6] ..... G03G 15/01

[52] U.S. Cl. ..... 399/231; 399/40

[58] Field of Search ..... 399/186, 39, 40, 399/223, 231, 228, 298; 430/42

[56] References Cited

U.S. PATENT DOCUMENTS

| | | | |
|---|---|---|---|
| 5,241,356 | 8/1993 | Bray et al. | 399/232 |
| 5,500,727 | 3/1996 | Maruyama et al. | 399/39 |
| 5,537,198 | 7/1996 | Jackson | 355/326 R |
| 5,576,824 | 11/1996 | Folkins | 399/228 |
| 5,579,100 | 11/1996 | Yu et al. | 355/326 R |
| 5,581,330 | 12/1996 | Pietrowski et al. | 355/221 |
| 5,600,430 | 2/1997 | Folkins et al. | 399/171 |

*Primary Examiner*—Arthur T. Grimley
*Assistant Examiner*—Quana Grainger
*Attorney, Agent, or Firm*—John M. Kelly

[57] ABSTRACT

A color REaD IOI system in which a light source illuminates the photoreceptor so as to erase that photoreceptor after the development of a first toner followed by a high slope AC corona system which recharges both the photoreceptor and first developed toner before exposure and development of the next color image.

6 Claims, 1 Drawing Sheet

ERASE BEFORE A.C. RECHARGE IN COLOR ELECTROGRAPHIC PRINTING

FIELD OF THE INVENTION

This invention relates to electrophotographic color printers, and in particular to the charging and recharging of the photoreceptor.

BACKGROUND OF THE INVENTION

Electrophotographic marking is a well known and commonly used method of copying or printing documents. Electrophotographic marking is performed by exposing a light image representation of a desired document onto a substantially uniformly charged photoreceptor. In response to that light image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

The foregoing broadly describes a prototypical black and white electrophotographic printing machine. Electrophotographic marking can also produce color images by repeating the above process once for each color of toner that is used to make the composite color image. For example, in one color process, referred to herein as the REaD IOI process (Recharge, Expose, and Develop, Image On Image), a charged photoreceptive surface is exposed to a light image which represents a first color, say black. The resulting electrostatic latent image is then developed with black toner particles to produce a black toner image. The charge, expose, and develop process is repeated for a second color, say yellow, then for a third color, say magenta, and finally for a fourth color, say cyan. The various color toner particles are placed in superimposed registration so that a desired composite color image results. That composite color image is then transferred and fused onto a substrate.

The REaD IOI process can be implemented in various ways. For example, in a single pass printer wherein the composite final image is produced in a single pass of the photoreceptor through the machine. A second implementation is in a four pass printer, wherein only one color toner image is produced during each pass of the photoreceptor through the machine and wherein the composite color image is transferred and fused during the fourth pass. REaD IOI can also be implemented in a five cycle printer, wherein only one color toner image is produced during each pass of the photoreceptor through the machine, but wherein the composite color image is transferred and fused during a fifth pass through the machine.

Single pass printing is very fast, but expensive since four charging stations and four exposure stations are required. Four pass printing is slower, since four passes of the photoreceptive surface are required, but also much cheaper since it only requires a single charging station and a single exposure station. Five cycle printing is even slower since five passes of the photoreceptive surface are required, but has the advantage that multiple uses can be made of various stations (such as using a charging station for transfer). Furthermore, five cycle printing also has the advantage of a smaller footprint. Finally, five cycle printing has a decided advantage in that no color image is produced in the same cycle as transfer, fusing, and cleaning when mechanical loads are placed on the drive system.

In the REaD IOI process the photoreceptor is initially charged for the first exposure and then it is recharged for subsequent exposures. Recharging is relatively difficult since the photoreceptor may have anywhere from zero to three layers of toner on the photoreceptor. A difficult constraint in recharge is to minimize the charge imparted to previously developed toner. The voltage drop due to this toner charge will limit the development of subsequent image separations over this toner. Recharging can be performed using either a single AC charging device, or "split charging" using both a DC charging device and an AC charging device. In split charging a first charging station overcharges an image area and a subsequent second charging station neutralizes the overcharge. In these cases the toner voltage is reduced by some amount of opposite polarity or "wrong sign" ions delivered during recharge. A more complete description of split charging may be found in U.S. Pat. No. 5,600,430 entitled, "Split Recharge Method and Apparatus for Color Image Formation. A more complete description of AC recharge may be found in U.S. Pat. No. 5,581,330 entitled, "Method and Apparatus For Reducing Residual Toner Voltage".

However, in REaD IOI systems that directly recharge using AC only charging or split charging it has been found that during the following development step, the first toner layer is sometimes pulled off of the photoreceptor and deposited into the next developer that is used, resulting in cross-contamination of the toner particles. This cross contamination is exacerbated by the low charge toner in the first toner layer resulting from the toner voltage reduction employed during the recharge step. Cross contamination can be reduced by adjustment of development parameters and voltages but at the expense of narrow line and dot development. Thus in the prior art a trade-off had to be made.finer lines at the price of increased cross-contamination. Therefore, new techniques for reducing cross-contamination would be beneficial.

SUMMARY OF THE INVENTION

This invention provides for a technique that is useful in assisting the reduction of cross-contamination, as well as in minimizing the total charge imparted to any previously developed toner layers, which is improves READ Image-On-Image development. The principles of the present invention provide for color REaD IOI system in which a lamp illuminates the photoreceptor so as to erase that photoreceptor after development of the first toner layer but before a subsequent A.C. recharging of the photoreceptor for the exposure of the next color image. Such exposure is beneficially performed using an erase device that is also used for other purposes (such as using a pretransfer or a precharge erase device

BRIEF DESCRIPTION OF THE DRAWINGS

Other aspects of the present invention will become apparent as the following description proceeds and upon reference to FIG. 1, which schematically illustrates an electrophotographic printing machine that incorporates the principles of the present invention.

DETAILED DESCRIPTION

Figure 1:
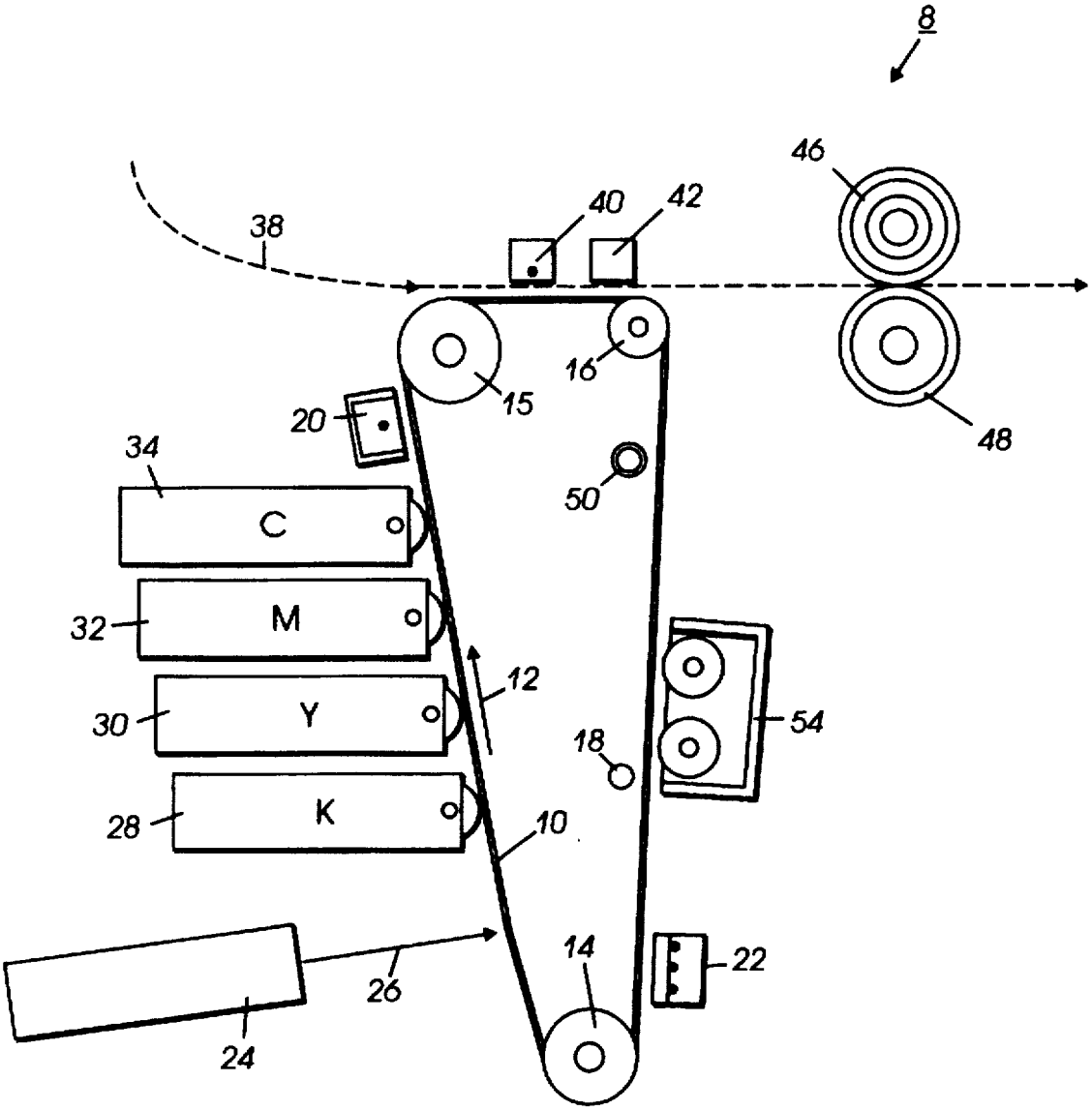

Referring now to FIG. 1, the preferred embodiment of the present invention is an electrophotographic printing machine 8 in which the photoreceptor is erased between the development of any color separation toner and the recharging of the photoreceptor for exposure of the next color separation image. The preferred embodiment includes a plurality of individual subsystems which are known in the prior art, but which are organized and used so as to produce a color image in 5 passes, or cycles, of a photoreceptive member.

The printing machine 8 includes an Active Matrix (AMAT) photoreceptor belt 10 which travels in the direction indicated by the arrow 12. Belt travel is brought about by mounting the photoreceptor belt about a drive roller 14 (that is driven by a motor which is not shown) and tension rollers 15 and 16.

As the photoreceptor belt travels, each part, of it passes through each of the subsequently described process stations. For convenience, a single section of the photoreceptor belt, referred to as the image area, is identified. The image area is that part of the photoreceptor belt which is to receive the various toner layers which, after being transferred and fused to a substrate, produce the final color image. While the photoreceptor belt may have numerous image areas, since each image area is processed in the same way, a description of the processing of one image area suffices to fully explain the operation of the printing machine.

As mentioned, the production of a color document takes place in 5 cycles. The first cycle begins with the image area passing a "precharge" erase lamp 18 that illuminates the image area so as to cause any residual charge which might exist on the image area to be discharged. Such erase lamps are common in high quality systems and their use for initial erasure is well known.

As the photoreceptor belt continues its travel, the image area passes through a charging station comprised of an AC scorotron or other high slope AC corona device, 22. To charge the image area in preparation for exposure to create a latent image for black toner, the AC scorotron charges the image area to a substantially uniform potential of, for example, about −500 volts. It should be understood that the actual charge placed on the photoreceptor for the black toner, (and the other toner layers that are subsequently described) will depend upon many variables, such as toner mass and the settings of the development station (see below).

After passing through the charging station the image area advances until it reaches an exposure station 24. At the exposure station the charged image area is exposed to a modulated laser beam 26 that raster scans the image area such that an electrostatic latent representation of a black image is produced. For example, illuminated sections of the image area might be discharged by the beam 26 to about −50 volts. Thus after exposure the image area has a voltage profile comprised of relatively high voltage areas of about −500 volts and of relatively low voltage areas of about −50 volts, where the high voltage areas correspond to the background or "non-image" area and the low voltage areas correspond to the desired printed areas.

After passing the exposure station 24 the exposed image area passes a black development station 28 which deposits negatively charged black toner particles onto the image area. The charged black-toner adheres to the illuminated areas of the image area thereby causing the voltage of the illuminated parts of the image area to be about −200 volts. The non-illuminated parts of the image area remain at −500 volts.

While the first black development station 28 could be a magnetic brush developer, a scavengeless developer may be somewhat better. One benefit of scavengeless development is that it does not disturb previously deposited toner layers. Since during the first cycle the image area does not have a previously developed toner layer, the use of scavengeless development is not absolutely required as long as the developer is disengaged during other cycles. However, since the other development stations (described below) use scavengeless development it may be better to use scavengeless development at each development station.

After passing the black development station the image area advances past a number of other stations whose purposes are described subsequently and returns to the precharge erase lamp 18. The second cycle then begins.

As previously mentioned, if either AC re-charging or split re-charging were directly used to recharge the image areas in the second cycle, significant amounts of black toner particles might be pulled off of the photoreceptor and deposited into the developer, thereby causing cross-contamination. One reason for this contamination is that the charge placed on the photoreceptor (with its black toner particles) in preparation for the yellow image, while depending upon many variables, is usually less than the charge placed on the photoreceptor for the black image. Directly using AC recharging or split recharging would result in the charge level on the photoreceptor being correct, but individual toner particles might have incorrect charges as a result of a large number of positive ions from the AC recharger that are required to level the charges on the photoreceptor. While DC only recharging would eliminate the positive ions, since the yellow photoreceptor potential is usually less than that of the unexposed areas of the image area, a DC only recharge can not level the charge on the photoreceptor (which needs positive ions to neutralize the unexposed areas).

It has been found that a successful recharge can be performed if the photoreceptor is first exposed so as to reduce the charges on the image area prior to recharging. In the electrophotographic printing machine 8 this is performed using the precharge erase lamp 18 to expose the image area. As the image area advances past the precharge erase lamp 18, that lamp illuminates the image area. The developed image area is discharged by the erase lamp, 18, thereby reducing the photoreceptor potential to its residual voltage of about −25 v plus any voltage due to the charge on the developed toner.

After passing the precharge erase lamp the AC scorotron 22 recharges the image area to the charge level desired for exposure and development of the yellow image, for example −450 v. A DC recharge following erase would overcharge the toner and cause "toner explosions" if the photoreceptor is subsequently discharged adjacent to the black toned image. A DC recharge for subsequent image separations (magenta and cyan) will also reduce the "Image-On-Image" development of color toner over color toner (for example cyan over magenta) due to the increase in the toner voltage of the initially developed color toner. AC recharge following erase will add enough positive ions to counterbalance these "overcharge" effects but will add less positive ions then either AC without erase or Split Recharge.

Beneficially the AC scorotron has a high slope: a small voltage variation on the image area results in large charging currents. Beneficially, the voltage applied to the metallic grid of the AC scorotron 22 can be used to control the voltage at which charging currents are supplied to the image area. In this case, primarily single polarity (negative) ions are delivered to the photoreceptor and developed toner due to the electric field direction. However, the use of a high I-V slope AC corona device will cause a small amount of opposite polarity (positive) ions to be delivered to the photoreceptor and developed toner to enable some toner charge and voltage reduction. This achieves a "trade-off" by delivering primarily negative ions to reduce cross-contamination, but delivering some positive ions to reduce the toner voltage and charge, thus reducing toner explosions and also enabling "Image-On-Image" development of subsequent separation toners over earlier separation toners. Further benefits of the positive ions include possible reduction of background transfer and improvements in image transfer by not overcharging the toner.

The recharged image area with its first separation toner layer then advances to the exposure station 24. The exposure station exposes the image area with the beam 26 so as to produce an electrostatic latent representation of a yellow image. As an example of the charges on the image area, the non-illuminated parts of the image area might have a potential about −450 while the illuminated areas are discharged to about −50 volts.

After passing the exposure station 24 the now exposed image area advances past a yellow development station 30 that deposits yellow toner onto the image area. Since the image area already has a black toner layer, the yellow development station should use a scavengeless developer.

After passing the yellow development station, the image area and its two toner layers advance past the precharge exposure lamp 18, which is once again illuminated so as to discharge the image area. This is the start of the third cycle. The AC scorotron 22 recharges the image area and its two toner layers in preparation for the third exposure station. The exposure station 24 again exposes the image area to the beam 26, this time with a light representation that discharges some parts of the image area to create an electrostatic latent representation of a magenta image. The image area then advances through a magenta development station 32. The magenta development station, preferably a scavengeless developer, advances magenta toner onto the image area. The result is a third toner layer on the image area.

The image area with its three toner layers then advances past the illuminated precharge erase lamp 18. The fourth cycle begins. The AC scorotron 22 again recharges the image area (which now has three toner layers) to produce the desired charge on the photoreceptor. The substantially uniformly charged image area with its three toner layers then advances once again to the exposure station 24. The exposure station exposes the image area again, this time with a light representation that discharges some parts of the image area to create an electrostatic latent representation of a cyan image. After passing the exposure station the image area passes a cyan development station 34. The cyan development station, also a scavengeless developer, advances a cyan toner onto the image area.

After passing the cyan development station the image area has four toner layers which together make up a composite color toner image. That composite color toner image is comprised of individual toner particles which have charge potentials which vary widely. Some of those particles may take a positive charge. Transferring such a composite toner image onto a substrate would result in a degraded final image. Therefore it is beneficial to prepare the composite color toner image for transfer. The preparation is performed in a fifth cycle in which a corona device 20 performs a pre-transfer charging function. A sufficient number of negative ions are supplied to the image area such that substantially all of the previously positively charged toner particles are reversed in polarity.

The image area continues to advance in the direction 12, past the tension roller 15. A substrate 38 is then placed over the image area using a sheet feeder (which is not shown). As the image area and substrate continue their travel they pass a transfer corotron 40. That corotron applies positive ions onto back of the substrate 38. Those ions attract the negatively charged toner particles onto the substrate.

As the substrate continues its travel it passes a detack corotron 42. That corotron neutralizes some of the charge on the substrate to assist separation of the substrate from the photoreceptor 10. As the lip of the substrate moves around the tension roller 16, the lip separates from the photoreceptor. The substrate is then directed into a fuser where a heated fuser roller 46 and a pressure roller 48 create a nip through which the substrate 38 passes. The combination of pressure and heat at the nip causes the composite color toner image to fuse into the substrate 38. After fusing, a chute, not shown, guides the support sheets 38 to a catch tray, also not shown, for removal by an operator.

After the substrate is separated from the photoreceptor belt 10 the image area continues its travel and passes a preclean erase lamp 50. That lamp neutralizes most of the charge remaining on the photoreceptor belt and on any residual toner or debris that may be on the photoreceptor. After passing the preclean erase lamp the residual toner and/or debris on the photoreceptor is removed at a cleaning station 52. At the cleaning station the cleaning brushes remove residual toner particles from the image area. This marks the end of the 5th cycle. The image area then passes once again to the precharge erase lamp 18 and the start of another 5 cycles.

Using well known technology the various machine functions described above are generally managed and regulated by a controller which provides electrical command signals for controlling the operations described above.

It is to be understood that while the figures and the above description illustrate the present invention, they are exemplary only. Others who are skilled in the applicable arts will recognize numerous modifications and adaptations of the illustrated embodiment which will remain within the principles of the present invention. For example, while the described embodiment is a five cycle electrophotographic printing machine, the present invention is just as applicable to four cycle electrophotographic printing machines. Therefore, the present invention is-to be limited only by the appended claims.

What is claimed:

1. A color printing machine, comprising:

a photoreceptor having an undeveloped area with an electrical charge of a first magnitude and a developed area having a first toner layer that is charged at a second magnitude;

an erase lamp for illuminating said photoreceptor so as to discharge said photoreceptor such that the electrical charge on said undeveloped area is reduced to a third magnitude, wherein said third magnitude is less than said second magnitude;

an AC charging device for charging said photoreceptor such that the electrical charge on said undeveloped area is increased from said third magnitude to a fourth magnitude;

an exposure station for exposing said photoreceptor so as to produce a latent image on said photoreceptor; and a developing station for depositing a charged second toner layer on said latent image.

2. A color printing machine according to claim 1, wherein said first toner layer is black.

3. A color printing machine according to claim 2, wherein said second toner layer is yellow.

4. A color printing machine according to claim 1, further including:

a developing station for depositing charged toner of a third color on said photoreceptor so as to form a third toner layer;

a developing station for depositing charged toner of a fourth color on said photoreceptor so as to form a fourth toner layer;

a transfer station for transferring said first toner layer, said second toner layer, said third toner layer, and said fourth toner layer onto a substrate; and a cleaning station for removing residual toner and debris from said photoreceptor.

5. A color printing machine according to claim 4, further including an erase lamp, wherein said erase lamp is used for multiple purposes.

6. A color printing machine according to claim 5, wherein said erase lamp is used to erase said photoreceptor before said first toner layer is developed, and wherein said erase lamp is used to erase said photoreceptor just before said first toner layer, said second toner layer, said third toner layer, and said fourth toner layer are transferred by said transfer station.

* * * * *